US005361977A

United States Patent [19]

Ogrodnick, Jr.

[11] Patent Number: 5,361,977

[45] Date of Patent: Nov. 8, 1994

[54] MODULAR MAILBOX HOUSING ASSEMBLY

[76] Inventor: Michael Ogrodnick, Jr., 5032 Waxhaw Indian Trail Rd., Matthews, N.C. 28105

[21] Appl. No.: 114,499

[22] Filed: Aug. 31, 1993

[51] Int. Cl.[5] ..... B65D 91/00

[52] U.S. Cl. ..... 232/39; 52/301; 52/284; 52/314

[58] Field of Search ..... 232/17, 38, 39; 52/301, 52/302, 284, 286, 293, 289, 218, 219, 314, 315, 316, 438

[56] References Cited

U.S. PATENT DOCUMENTS

| | | | |
|---|---|---|---|
| 219,120 | 9/1879 | Schreier | 52/606 |
| 494,874 | 4/1893 | Majola | 232/17 |
| 899,349 | 9/1908 | Steiber | 52/301 |
| 1,297,652 | 3/1919 | Brunner | 52/593 |
| 1,409,155 | 3/1922 | Covan | 52/301 |
| 1,553,158 | 9/1925 | Henderson | 232/39 |
| 2,047,648 | 7/1936 | Pollard | 52/315 |
| 2,128,463 | 8/1938 | Kauffmann | 52/218 |
| 4,498,621 | 2/1985 | Diamond | 232/17 |
| 4,875,622 | 10/1989 | Lents | 232/39 |

*Primary Examiner*—Flemming Saether
*Attorney, Agent, or Firm*—W. Thad Adams, III

[57] ABSTRACT

A modular mailbox housing assembly includes at least one hollow unitary base module for being positioned on a supporting surface. A hollow unitary mailbox-holding module is positioned on top of the at least one base module. The mailbox-holding module has an opening formed in a sidewall thereof of a size and shape to receive and enclose into the hollow area of the mailbox-holding module the top, bottom and closed end of a standard roadside mailbox with the door of the mailbox exposed on a sidewall of the mailbox-holding module for access by users. A cap is positioned on top of the mailbox-holding module for enclosing the top of the mailbox housing assembly. A locking flange locks the at least one base module and the mailbox-holding module in vertical registration with each other.

7 Claims, 5 Drawing Sheets

MODULAR MAILBOX HOUSING ASSEMBLY

TECHNICAL FIELD AND BACKGROUND OF THE INVENTION

This invention relates to a modular mailbox housing assembly. The invention is designed to improve the appearance of standard roadside mailboxes by providing a decorative housing for enclosing the mailbox. Additionally, the invention serves to shelter the mailbox from adverse weather conditions and other potentially damaging occurrences, such as vandalism.

Mailbox housings are known in the art, and are commonly constructed of laid brick or stone. These such custom-built housings ordinarily cost hundreds of dollars to construct, and often require the employ of a skilled professional. Damage to the mailbox housing is difficult to repair, and in extreme cases, complete reconstruction of the housing is required.

The present invention eliminates the high cost and skill associated with laid brick or stone constructed mailbox housings by providing a mailbox housing which is relatively inexpensive, and easy to construct. Additionally, the mailbox housing of the present invention may be easily repaired or reconditioned.

SUMMARY OF THE INVENTION

Therefore, it is an object of the invention to provide a mailbox housing assembly which substantially improves upon the appearance of a standard road side mailbox.

It is another object of the invention to provide a mailbox housing assembly which shelters and protects the mailbox from adverse weather conditions and other potentially damaging occurrences.

It is another object of the invention to provide a mailbox housing assembly which is relatively easy to construct.

It is another object of the invention to provide a mailbox housing assembly which is relatively inexpensive.

It is another object of the invention to provide a mailbox housing assembly which is modular, making repairs relatively easy and inexpensive.

It is another object of the invention to provide a mailbox housing assembly which may be readily constructed by a homeowner without the aid of a skilled professional.

These and other objects of the present invention are achieved in the preferred embodiments disclosed below by providing a modular mailbox housing assembly. The mailbox housing assembly includes at least one hollow unitary base module for being positioned on a supporting surface. A hollow unitary mailbox-holding module is positioned on top of the at least one base module. The mailbox-holding module has an opening formed in a sidewall thereof of a size and shape to receive and enclose into the hollow area of the mailbox-holding module the top, bottom and closed end of a standard roadside mailbox with the door of the mailbox exposed on a sidewall of the mailbox-holding module for access by users. A cap is positioned on top of the mailbox-holding module for enclosing the top of the mailbox housing assembly. A locking means locks the at least one base module and the mailbox-holding module in vertical registration with each other.

According to one preferred embodiment of the invention, the at least one base module and mailbox-holding module have substantially the same outside dimensions, and cooperate to form a vertical, substantially quadralinear column when stacked.

According to another preferred embodiment of the invention, the at least one base module and mailbox-holding module have substantially the same outside dimensions, and cooperate to form a vertical, substantially cylindrical column when stacked.

Preferably, the locking means is a locking flange located on the inner peripheral edge of the top of the at least one base module for engaging the bottom of the mailbox-holding module when stacked to thereby prevent the mailbox-holding module from shifting laterally on top of the at least one base module.

According to one preferred embodiment of the invention, the at least one base module and the mailbox-holding module include an outer surface molded with the shape and texture of laid brick to present the appearance a laid-brick mailbox housing assembly.

According to another preferred embodiment of the invention, the at least one base module and the mailbox-holding module include an outer surface molded with the shape and texture of laid stones to present the appearance of a laid-stone mailbox housing assembly.

According to one preferred embodiment of the invention, the at least one base module and the mailbox-holding module are constructed of a molded plastic.

According to another preferred embodiment of the invention, the at least one base module and the mailbox-holding module are constructed of concrete.

BRIEF DESCRIPTION OF THE DRAWINGS

Some of the objects of the invention have been set forth above. Other objects and advantages of the invention will appear as the invention proceeds when taken in conjunction with the following drawings, in which.

Description of the Preferred Embodiment and Best Mode

Figure 1:
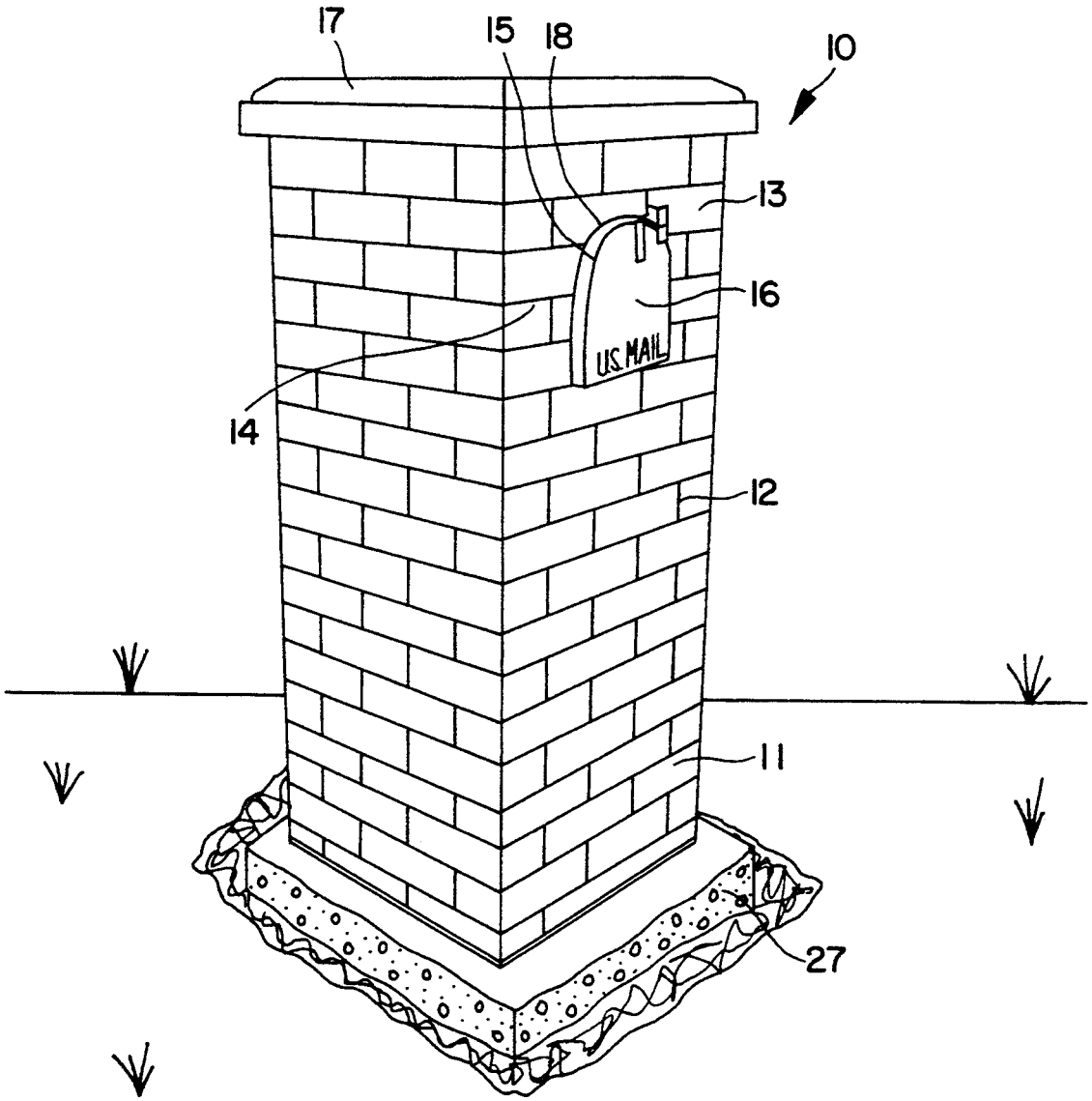
FIG. 1 is a perspective view of the invention with foundation parts broken away.

Referring now specifically to the drawings, a modular mailbox housing assembly according to the present invention is illustrated in FIG. 1 and shown generally at reference numeral 10. The mailbox housing assembly 10 is designed particularly for housing a standard roadside mailbox 15 having a size and shape according to specifications set forth by the U.S. Postal Service.

Figure 2:
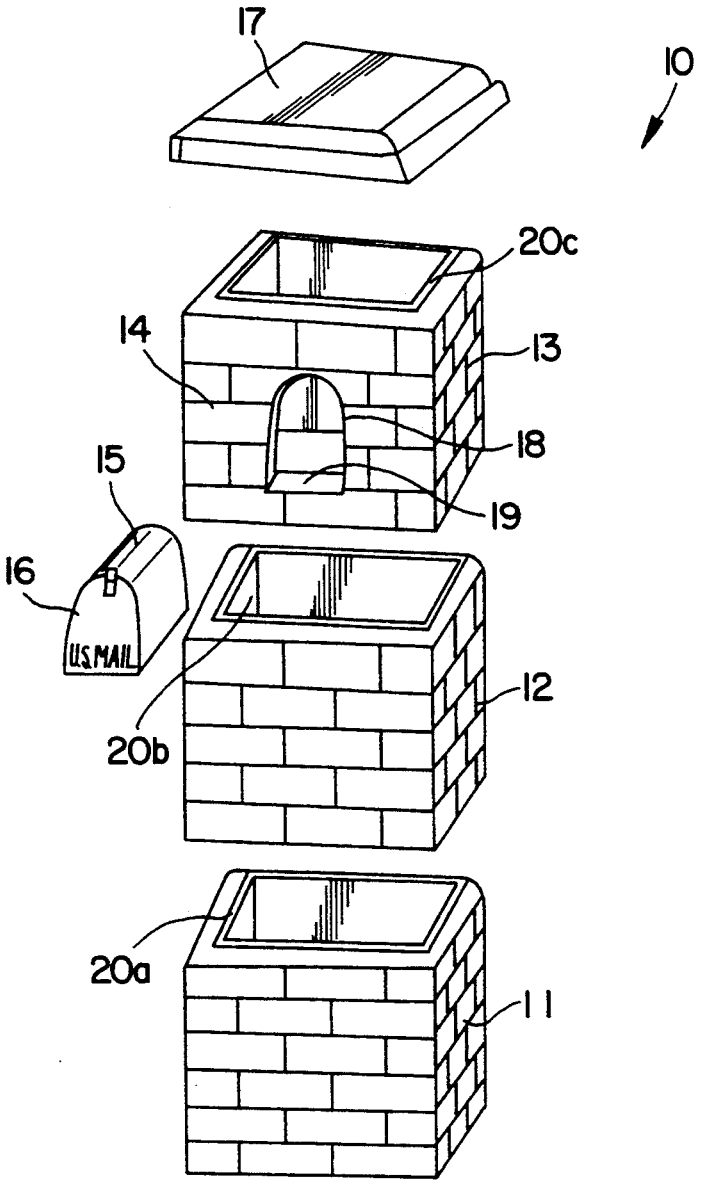
FIG. 2 is an exploded view of the invention illustrated in FIG. 1.

As best illustrated in FIGS. 1 and 2, the mailbox housing assembly 10 includes first and second hollow unitary base modules 11 and 12, and a hollow unitary mailbox-holding module 13. Preferably, the modules 11, 12, and 13 have substantially the same outside dimensions, and cooperate to form a vertical column when stacked. The column may be quadralinear, as shown in FIGS. 1–5. However, other shaped columns, such as triangular and cylindrical columns (not shown), may likewise be constructed.

The lowermost base module 11 is preferably bolted to a concrete support slab 27 with suitable lag bolts and brackets (not shown) on the interior bottom edge of the module 11. Alternately, the base module 11 may be mounted into a recessed foundation, or simply mounted on any flat supporting surface.

The mailbox-holding module 13 has an opening 18 formed in a sidewall 14 thereof. The opening 18 is preferably of a size and shape to receive and enclose into the hollow area of the mailbox-holding module 13 the mailbox 15 with the door 16 of the mailbox 15 exposed on the sidewall 14 of the mailbox-holding module 13 for access by users (See FIG. 1). As best shown in FIG. 2, the mailbox-holding module 13 includes a ledge support 19 for supporting and holding the mailbox within the opening 18. Additionally, masonry screws (not shown) may be used to further secure the mailbox within the opening 18.

Figure 3:
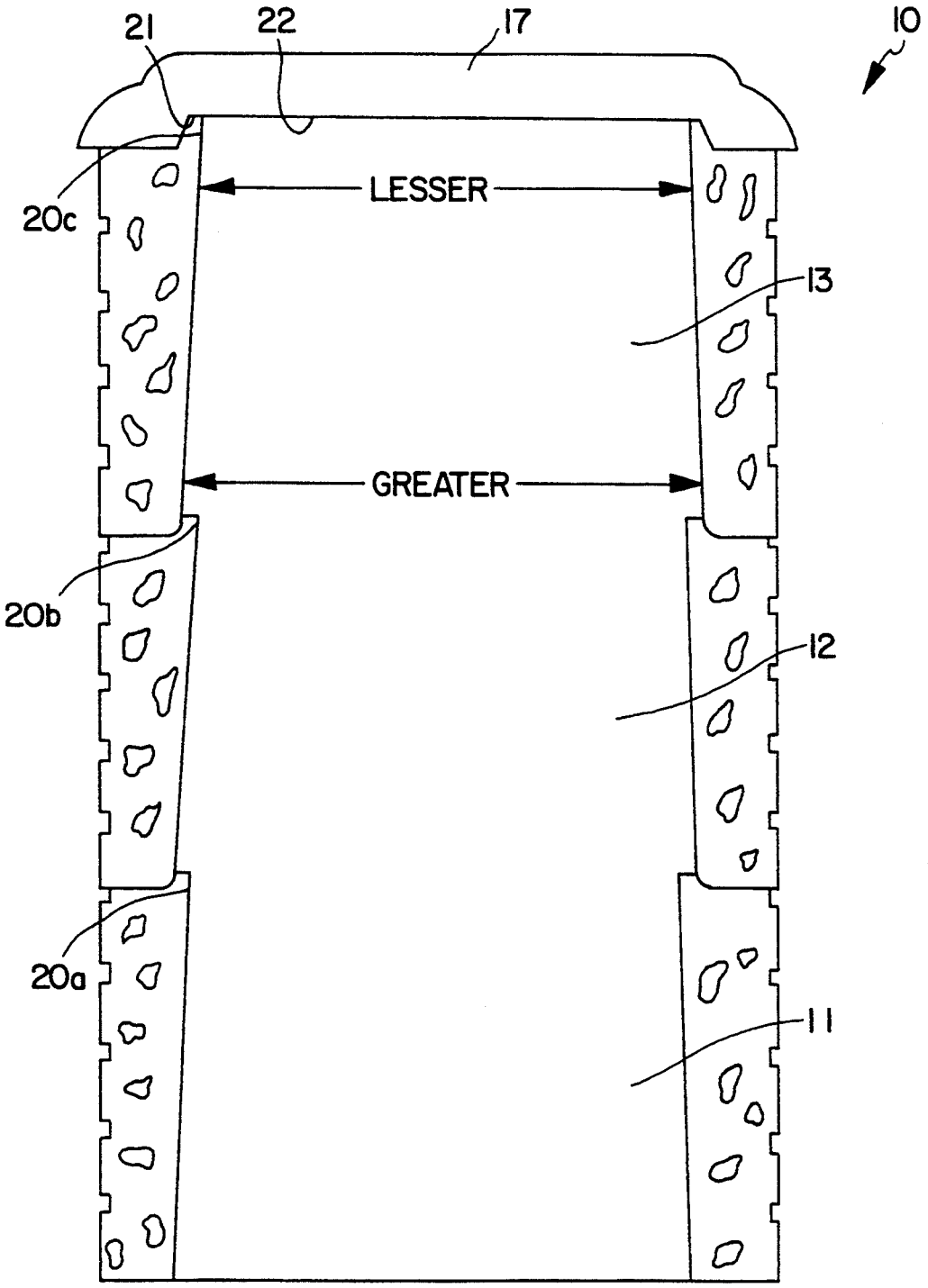
FIG. 3 is a vertical cross-sectional view of the invention with the mailbox removed, illustrating particularly the respective locking flanges of the modules.

The mailbox housing assembly 10 may include a cap 17 for enclosing the top of the mailbox housing assembly 10. Preferably, the cap 17 has a bottom perimeter surface 21 and a recessed area 22 as shown in FIG. 3.

Figure 4:
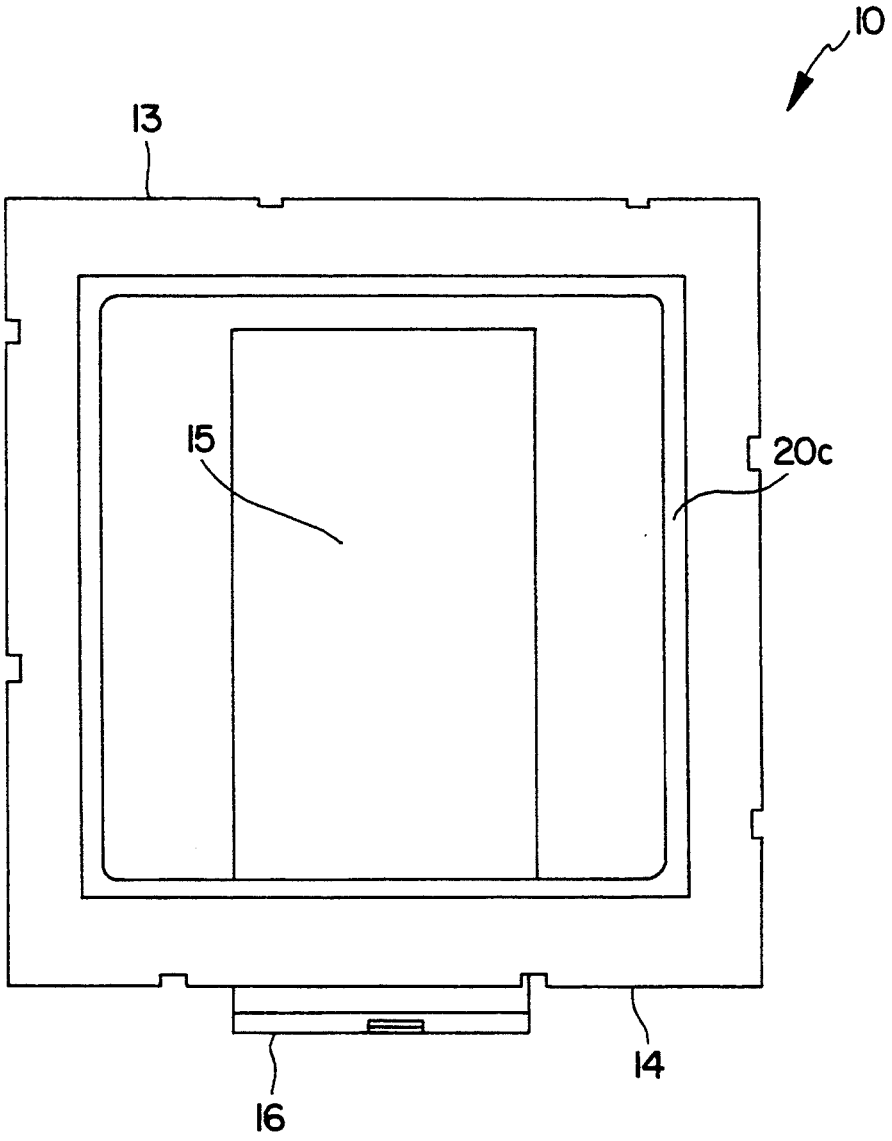
FIG. 4 is a top plan view of the invention with the cap removed.

The mailbox housing assembly 10 preferably includes locking means for locking the base modules 11 and 12 and the mailbox-holding module 13 in vertical registration with each other, thereby preventing any lateral shifting of the modules 11, 12, and 13. As shown in FIGS. 2, 3, and 4, the locking means comprises locking flanges 20*a–c*. The locking flanges 20*a–c* are located, respectively, on the inner peripheral edge of the top of the base modules 11 and 12 and mailbox-holding module 13. The locking flanges 20*a–c* may be integrally molded to the respective modules 11, 12, and 13. As shown in FIG. 3, the locking flange 20*a* protrudes upwardly, adjacent to the inside surface of the base module 12, and the locking flange 20*b* protrudes upwardly, adjacent to the inside surface of the mailbox-holding module 13. Similarly, the locking flange 20*c* of the mailbox-holding module 13 protrudes upwardly within the recessed area 22 of the cap 17.

According to one embodiment of the invention, the modules 11, 12, and 13 are constructed of concrete. A wire mesh may be placed in the concrete prior to curing for reinforcement.

Preferably, the concrete is poured into one or more lubricated molds (not shown) designed and fabricated to provide the shape, texture, and outer surface appearance of the respective modules 11, 12, and 13. As shown in FIG. 3, the side walls of each module 11, 12, and 13 preferably taper slightly outward to facilitate the removal of the mold from the module. The opening 18 in the mailbox-holding module may be formed by placing a properly-shaped obstruction, such as a wooden block, into the mold prior to hardening of the concrete. An additional opening (not shown) may be formed in one side wall of the modules 11, 12, or 13 for receiving a newspaper. The cap 17 may likewise be constructed of concrete, and formed from a separate lubricated mold.

Figure 5:
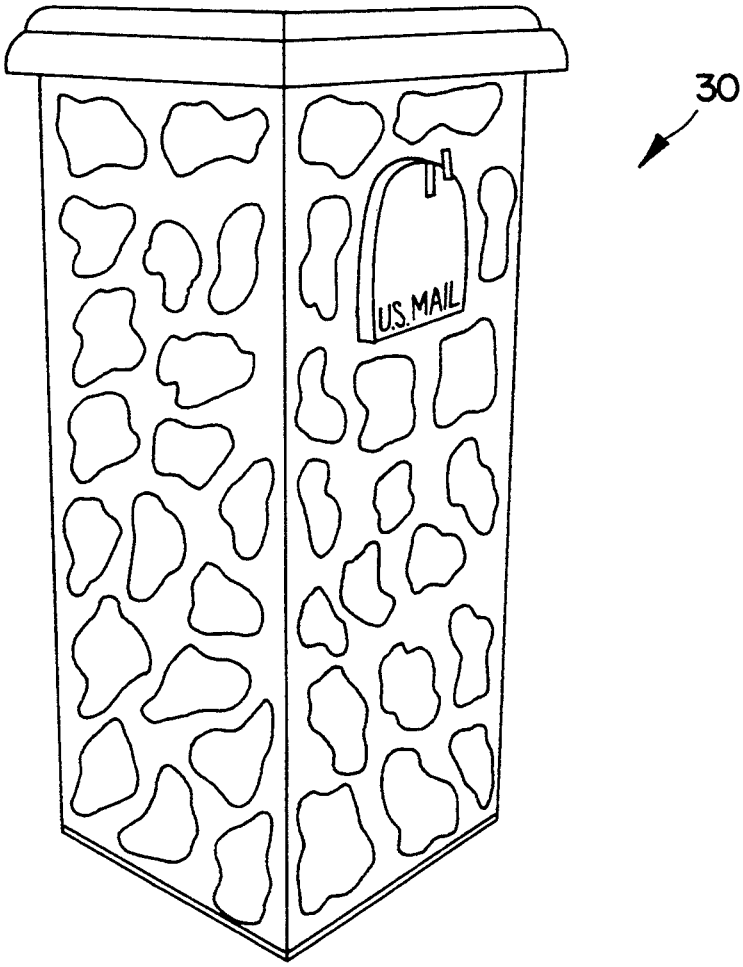
FIG. 5 is a perspective view according to an alternate embodiment of the invention.

Once the concrete has cured and the modules 11, 12, and 13 are stacked, the resulting appearance of the mailbox housing assembly 10 resembles a laid-brick construction as shown in FIGS. 1 and 2. Other various molds are used for creating a mailbox housing assembly 30 having a different look, such as a laid-stone construction as shown in FIG. 5. Additionally, a colored die can be inserted with the material in the mold to create a desired colored appearance. Alternately, the exterior of the mailbox housing assembly 10, 30 may be painted or coated with an epoxy.

A silicone adhesive or construction cement applied to the adjacent surfaces of the modules 11, 12, 13, and cap 17 is preferably used to bond the modules 11, 12, 13, and cap 17 together. Additionally, the modules 11, 12, 13, and cap 17 can be constructed of other suitable materials, such as plastic.

The mailbox housing assembly of the present invention may have other various applications, such as for decorative columns or fence posts. The opening 18 would not be formed in the module 13 for these such embodiments.

A modular mailbox housing assembly is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A modular mailbox housing assembly, comprising:

(a) at least one hollow unitary base module for being positioned on a supporting surface;

(b) a hollow unitary mailbox-holding module for being positioned on top of said at least one base module, said mailbox-holding module having an opening formed in a sidewall thereof of a size and shape to receive and enclose into the hollow area of the mailbox-holding module the top, bottom and closed end of a standard roadside mailbox with the door of the mailbox exposed on a sidewall of the mailbox-holding module for access by users;

(c) a cap positioned on top of the mailbox-holding module for enclosing the top of the mailbox housing assembly; and (d) locking means for locking the at least one base module and the mailbox-holding module in vertical registration with each other.

2. A mailbox housing assembly according to claim 1, wherein said locking means comprises a locking flange located on an inner peripheral edge of the top of said at least one base module for engaging a bottom interior of said mailbox-holding module when stacked to thereby prevent said mailbox-holding module from shifting laterally on top of said at least one base module.

3. A mailbox housing assembly according to claim 1, wherein said at least one base module and said mailbox-holding module have substantially the same outside dimensions, and cooperate to form a vertical, substantially quadralinear column when stacked.

4. A mailbox housing assembly according to claim 1, wherein said at least one base module and said mailbox-holding module include an outer surface molded with the shape and texture of laid brick to present the appearance a laid-brick mailbox housing assembly.

5. A mailbox housing assembly according to claim 1, wherein said at least one base module and said mailbox-holding module include an outer surface molded with the shape and texture of laid stones to present the appearance of a laid-stone mailbox housing assembly.

6. A mailbox housing assembly according to claim 1, wherein said at least one base module and said mailbox-holding module are constructed of a molded plastic.

7. A mailbox housing assembly according to claim 1, wherein said at least one base module and said mailbox-holding module are constructed of concrete.

* * * * *